US005112518A

United States Patent [19]

Klugkist et al.

[11] Patent Number: 5,112,518

[45] Date of Patent: May 12, 1992

[54] ENZYMATIC DISHWASHING COMPOSITION CONTAINING A CHLORINE-TYPE BLEACHING AGENT

[75] Inventors: Jan Klugkist, Vlaardingen; Willem R. Van Dijk, Oud-Beijerland, both of Netherlands

[73] Assignee: Lever Brothers Company, Division of Conopco, Inc., New York, N.Y.

[21] Appl. No.: 449,134

[22] Filed: Dec. 8, 1989

Related U.S. Application Data

[63] Continuation-in-part of Ser. No. 364,740, Jun. 9, 1989, abandoned.

[30] Foreign Application Priority Data

Jun. 9, 1988 [GB] United Kingdom ..... 8813688

[51] Int. Cl.[5] ..... C11D 3/386; C11D 3/395

[52] U.S. Cl. ..... 252/174.12; 252/89.1; 252/95; 252/99; 252/135; 252/156; 252/174.24; 252/187.25; 252/187.33; 252/187.34

[58] Field of Search ..... 252/174.12, DIG. 12, 252/187.25, 187.33, 187.34, 95, 99, 135, 156, 174.24, 89.1

[56] References Cited

U.S. PATENT DOCUMENTS

| | | | |
|---|---|---|---|
| 3,700,401 | 10/1972 | Spangler | 8/108 |
| 3,816,320 | 6/1974 | Corliss | 252/99 |
| 3,817,869 | 6/1974 | Ries et al. | 252/99 |
| 4,421,664 | 12/1983 | Anderson et al. | 252/94 |
| 4,501,681 | 2/1985 | Groult et al. | 252/174.12 |
| 4,707,291 | 11/1987 | Thom et al. | 252/174.12 |
| 4,769,173 | 9/1988 | Cornelissen et al. | 252/174.12 |
| 4,810,414 | 3/1989 | Huge-Jensen et al. | 252/174.12 |
| 4,908,150 | 3/1990 | Hessel et al. | 252/174.12 |
| 4,959,179 | 9/1990 | Aronson et al. | 252/135 |

FOREIGN PATENT DOCUMENTS 0258068 3/1988 European Pat. Off. .

OTHER PUBLICATIONS

Lipolase TM 30T Product Brochure, Dec. 1987.
Lipolase TM Application in Household Detergent Powders brochure, Dec. 1987.
"Biotechnology Newswatch", 7 Mar. 1988, p. 6.

*Primary Examiner*—Paul Lieberman
*Assistant Examiner*—A. Beadles-Hay
*Attorney, Agent, or Firm*—Ronald A. Koatz

[57] ABSTRACT

A dishwashing or rinsing composition comprising a surfactant and a chlorine-type bleaching agent, characterised in that it further comprises a lipolytic enzyme in an amount in the range 0.005 to 100 lipase units per mg (dry wt.) of the composition.

8 Claims, No Drawings

ENZYMATIC DISHWASHING COMPOSITION CONTAINING A CHLORINE-TYPE BLEACHING AGENT

This is a continuation-in-part application of Ser. No. 364,740, filed Jun 9, 1989 now abandoned.

U.S. Pat. No. 4,421,664 (Anderson et al.) discloses enzyme-containing cleaning compositions including slow-release oxidant bleach systems, including chlorine-type bleaches, and proteolytic, lipolytic or amylolytic enzyme, including e.g. Amano CE lipase, and formulated e.g. for mechanical dishwashing. The compositions of Anderson et al. may further include reducing agents which preferentially reduce any bleach composition which leak out from the capsule to a nonoxidizing compound. There is disclosed no appreciation that certain lipase enzymes are compatible with chlorine-type bleaches and do not require segregation in slow-release formulations or the presence of reducing agents.

The present invention relates to an enzymatic dishwashing composition comprising a chlorine-type bleaching agent, and is characterised by the use of lipase as further described below, and a process of (e.g. mechanical) dishwashing using such a composition.

The use of enzymes in dishwashing compositions, both for manual as well as mechanical dishwashing, is generally well known in the art. For that purpose in particular amylases and/or proteases have been proposed.

Although lipases as a general class of enzymes have also been suggested, no specific proposals relating to the use of lipases in dishwashing compositions have been made as far as we know.

Many dishwashing compositions contain a chlorine-type bleaching agent, and it is well known in the art that, on the whole, enzymes are not really compatible with such chlorine-type bleaching agents.

We have now surprisingly found that lipases in compositions which contain a chlorine-type bleaching are surprisingly more stable and do not lose their activity as rapidly as one would have expected.

There is no need for the compositions of the present invention to be formulated using any slow-release forms of the bleaching system. There is also no need for the compositions of the present invention to be formulated with reducing agents for reducing amounts bleach to a nonoxidizing form. The bleach system ingredients can thus be incorporated into the compositions in solid, pasty or liquid forms not involving their components in encapsulant substances. Accordingly, the invention includes compositions (e.g. those exemplified below) comprising bleach component which is free of encapsulation agents or other slow-release agents that would slow down the effect of the bleach, and free of reducing agents as well.

In addition, we have surprisingly found that less spot formation occurs when using the compositions of the invention, compared with a composition with a chlorine-type bleaching agent but without a lipase.

The present invention therefore relates to an enzymatic dishwashing composition comprising a detergent-active material, a lipase and a chlorine-type agent.

The lipases, used according to the present invention, may be of any suitable origin such as yeasts, fungi and bacteria. Preferably they are of bacterial or fungal origin. The bacterial lipases preferably belong to the class of bacterial lipases which show a positive immunological cross-reaction with antibody raised against the lipase produced by the microorganism *Chromobacter viscosum* var. lipolyticum NRRL B-3763.

This lipase has been described in Dutch Patent Specification 154,269 of Toyo Jozo, and the microorganism is available to the public at the U.S. Department of Agriculture, Agricultural Research Service, Northern Utilisation and Development Division at Peoria, Ill., under the number NRRL B-3673. This lipase will hereinafter be referred to as "Toyo Jozo" lipase. The preferred bacterial lipases of the present invention should show a positive immunological cross-reaction with the Toyo Jozo lipase antibody, using the standard and well-known immunodiffusion procedure according to Ouchterlony (Acta. Med. Scan., 133, pages 76–79 (1950)).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

Day 0: antigen in complete Freund's adjuvant
Day 4: antigen in complete Freund's adjuvant
Day 32: antigen in incomplete Freund's adjuvant
Day 60: booster of antigen in incomplete Freund's adjuvant.

The serum containing the required antibody is prepared by centrifugation of clotted blood, taken on day 67.

The titre of the anti-Toyo Jozo-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross reaction with the Toyo Jozo lipase antibody as hereabove described are preferred bacterial lipases according to the present invention. Typical examples thereof are the lipases ex *Pseudomonas fluorescens* IAM 1057 (available under the trade name Amano-P), the lipase ex *Pseudomonas fragi* FERM P 1339 (available under the trade name Amano-B), lipase ex *Pseudomonas nitroroducens* var. lipolyticum FERM P 1338, the lipase ex Pseudomonas sp. available under the trade name Amano-CES, the lipase ex *Pseudomonas cepacia*, lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from U.S. Biochemical Corp, U.S.A. and Diosynth Co., The Netherlands, and lipases ex *Pseudomonas gladioli*.

Suitable fungal lipases which may also be used in the present invention are lipases ex *Humicola lanuginosa* or *Thermomyces lanuginosus*, such as Amano-CE ex Amano or those described in the published European Patent Application 0 258 068 (Novo), (incorporated herein by reference).

Lipases particularly preferred to be used in the present invention are the lipases produced by cloning, by rDNA technologies, the gene encoding for the lipase produced by the fungus *Humicola lanuginosa* and expressing the gene in *Aspergillus oryzae* as host. Such a lipase is manufactured and sold by Novo Industri A/S, Denmark, under the trade name Lipolase (described in Biotechnology Newswatch, 7th Mar. 1988, page 6), and further such lipases are made in accordance with EP 0 305 216 (NOVO), (incorporated herein by reference).

The lipases of the present invention are included in the detergent composition in such an amount that the final detergent composition has a lipolytic enzyme activity of from 100 to 0.005 LU/mg preferably 25 to 0.05 LU/mg of the composition.

A Lipase Unit (LU) is that amount of lipase which produces 1 micromol of titratable fatty acid per minute in a pH stat. under the following conditions: temperature 30° C.; pH=9.0; substrate is an emulsion of 3.3 wt. % of olive oil and 3.3% gum arabic, in the presence of 13 mmol/l $Ca^{2+}$ and 20 mmol/l NaCl in 5 mmol/l Tris-buffer.

Naturally, mixtures of the above lipases can be used. The lipases can be used in their nonpurified form, or in a purified form, e.g. purified with the aid of well-known adsorption methods, such as a phenylsepharose-adsorption techniques.

The compositions further comprise a chlorine-type bleaching agent, generally in an amount corresponding to 0.1–15%, usually 0.5–10% by weight of available chlorine.

By chlorine-type bleaching agents, organic and/or inorganic compounds are meant, which yield, on solution in water, active chlorine. Typical examples are alkali metal hypochlorites, chlorinated trisodium phosphate, chlorinated (sulphon) amides, chlorinated hydantoins, chlorinated cyanuric acids and salts (usually alklai metal, e.g. sodium, salts) thereof, etc.

The compositions also contain a detergent-active compound, generally in an amount of from 0.5–10%, usually 1–5%. Any well-known type of detergent active compound may be used, such as soaps, synthetic anionic, non-ionic, amphoteric detergent surfactant and mixtures thereof. Preferably, a nonionic detergent surfactant is used, especially a low-foaming one. Suitable examples of such nonionic detergent surfactants can easily be found in M Schick "Nonionic Surfactants" (1967).

The composition of the invention may furthermore comprise the usual ingredients of dishwashing or rinse compositions. Thus it may contain one or more alkali salts commonly used in dishwashing compositions. Thus, it may contain organic and/or inorganic builders such as the alkali metal ortho-, pyro and tripolyphosphates and hexametaphosphates, silicates, carbonates, zeolites, borates, citrates, carboxymethyloxysuccinates, nitrilotriacetates and ethylenediamine-tetraacetates, polymeric polyelectrolytes such as polyacrylates, polymaleates, and other known organic and inorganic builder compounds.

Caustic alkali (e.g. NAOH) may also be additionally present, and the compositions often generate a pH>10 on dissolution/dispersion at a surfactant level in the range of 0.4–0.8 g/l.

Usually, the amount of builders in the composition varies from 10–90% by weight, generally from 30–70% by weight.

The composition may furthermore contain other useful additives such as oxygen-type bleaching agents such as perborate, reducing bleaching agents such as sodium sulphite, bleaching agent activators, hydrotropes, fillers, perfumes, colouring agents, germicides, soil-suspending agents, aminopoly-phosphonic acids and alkali metal or alkaline earth metal salts thereof, clays such as hectorites, anti-corrosion agents such as fatty acids, benztriazole and so on. Other enzymes such as proteases, e.g. Savinase® ex Novo, amylases, e.g. Termamyl® ex Novo, and oxidases may also be included.

In general, the dishwashing compositions of the invention (preferably those in solid e.g. powder or granulate form) may contain proteases in such an amount, that the final composition has a proteolytic activity of 0.1–50, usually 1–50 and preferably 5–30 GU/mg. A GU is a glycine unit, which is the amount of enzyme which under standard incubation conditions produces an amount of terminal $NH_2$-groups equivalent to 1 microgram/ml glycine.

It is explained that the preferred proteases are those of the subtilisen type (e.g. the Savinase preparation mentioned above), but it is preferred that the lipase preparation is itself substantially free of accompanying protease, e.g. less than about 0.3 GU per lipase unit, preferably not more than about 0.15 GU per lipase unit.

When amylases are present, they are used in such amounts that the final composition has an amylolytic activity of $10^3$–$10^7$ MU/kg of final product. A maltose unit (MU) is determined by the method as described in P Bernfeld in "Methods in Enzymology", Vol I, (1955), page 149.

A typical example of a machine dishwashing composition contains a lipase in an amount as set out above, an alkali metal tripolyphosphate in an amount of from 20–60%, an alkali silicate in an amount of from 40–80%, or an alkali metal disilicate in an amount of 5–30% by weight, a chlorine-type bleaching agent such as dichlorocyanuric acid (sodium or potassium salt) in an amount of from 0.5–10%, a low-foaming detergent surfactant in an amount of from 0.5–5%, and minor ingredients such as perfumes, colouring agents, hydrotropes, fillers, etc.

The products of the invention can be formulated in any desirable form, such as powders, granulates, cakes, bars, pastes, liquids etc. When the compositions are presented as liquids, the proportions given above are (wherever appropriate) expressed in terms of the dry weight.

The invention will further be illustrated by way of example.

EXAMPLE 1

The following formulations were made:

| | (% by weight) | | |
|---|---|---|---|
| | A | B | C |
| Granular sodium tripolyphosphate (7% water of hydration) | 36.0 | 38.7 | 35.0 |
| Sodium metasilicate (0.aq) | — | 16.5 | — |
| Sodium metasilicate (5.aq) | — | — | 7.0 |
| Granular sodium metasilicate (18% water of hydration) | — | — | 55.0 |
| Sodium disilicate | — | 11.0 | — |
| Sodium carbonate | 9.0 | — | — |
| $C_{13}$–$C_{15}$ linear alcohol, condensed with 2 moles of ethylene oxide and 4 moles of propylene oxide | — | — | 1.0 |
| $C_{12}$–$C_{15}$ near alcohol, condensed with 4.4 moles of ethylene oxide and 6.5 moles of propylene oxide | 1.4 | 1.0 | — |
| Sodium sulphate | 22.0 | 34.0 | — |
| Sodium dichlorocyanuric acid salt (2.aq) | 1.2 | 1.2 | 1.2 |
| Water to | 100.0 | 100.0 | 100.0 |

Solutions were made of 3 g/l of each of these formulations in water of 9° German hardness at 30° C. and Lipolase was added in an amount of 15 LU/ml. The residual activity was measured after 25 minutes storage. The following results were obtained:

| | residual activity (in %) |
|---|---|
| A | 60 |
| B | 65 |
| C | 35 |

EXAMPLE 2

With composition B of Example 1, the same test was repeated (at pH 10.9) with Lipolase, or the lipase ex *Pseudomonas cepacia* or the lipase ex *Humicola lanuginosa* according to European Patent Application 0 258 068, all dosed at 15 LU/ml.

The following results were obtained, showing that all three lipases retained a useful degree of activity, the preferred lipase being the Lipolase preparation.

| | residual activity (in %) |
|---|---|
| Lipolase | 65 |
| *Pseudomonas cepacia* | 10 |
| *Humicola lanuginosa* | 10 |

In relation to the above result, it is believed that the lipolase enzyme (highly preferred) is free of protease of fungal origin, while the Lipase obtained directly from *Humicola lanuginosa* had some fungal protease therein, (probably more than 0.3 GU per Lipase unit).

Repeating this test, using formulation B, in which, however, the sodium dichlorocyanuric acid salt was replaced by sodium hypochlorite (to yield 154 mg/l NaOCl solution), the following results were obtained:

| | residual activity (in %) |
|---|---|
| Lipolase | 65 |
| *Pseudomonas cepacia* | 20 |

EXAMPLE 3

Glasses were cleaned in a Kenmore Sears dishwashing machine, using the normal wash programme at 50° C. followed by a hot dry. The water hardness was 14° FH. The dishwashing composition was dosed in an amount of 3 g/l, and had the following formulation:

| | % by weight |
|---|---|
| sodium tripolyphosphate | 24.0 |
| soda ash | 20.0 |
| sodium disilicate | 11.0 |
| linear $C_{10}$ alcohol, condensed with 6 moles of ethylene oxide and 24 moles of propylene oxide | 2.5 |
| sodium sulphate | 44.0 |
| sodium dichlorocyanuric acid salt | 1.2 |
| water to | 100.0 |

The load was a dummy load without soil, and the soiling was 35 g/run fresh egg-yolk.

The glasses were washed once and the number of spots on the glasses was thereafter determined. These experiments were carried out with and without Lipolase (dosed at 15 LU/ml), with or without Savinase (dosed at 47 GU/ml).

The following results were obtained:

| | Number of spots on glass |
|---|---|
| Base powder without chlorine bleach | 281 |
| powder with chlorine bleach | 298 |
| powder with chlorine bleach + Lipolase | 36 |
| powder with chlorine bleach + Savinase | 330 |
| powder with chlorine bleach + Lipolase + Savinase | 38 |

The invention extends to all combinations and subcombinations of the features mentioned above and in the appended claims, within the scope of the claims.

We claim:

1. A dishwashing or rinsing composition comprising
(a) about 0.5 to 10% by weight of a surfactant;
(b) about 0.5 to 10% by weight of a chlorine-type bleaching agent; and
(c) a lipolytic enzyme in an amount in the range 0.005 to 100 lipase units per mg, dry wt., of the composition, wherein said lipolytic enzyme (c) is obtained by cloning the gene from Humicola lanuginosa and expressing this gene in Aspergillus oryzae, and wherein bleach component (b) is free of encapsulating agents or slow-release agents.

2. A composition according to claim 1, characterised in that the chlorine-type bleaching agent is selected from the group consisting of alkali metal hypochlorites, chlorinated trisodium phosphate, chlorinated sulphonamides, chlorinated hydratoins, chlorinated cyanuric acids and salts thereof.

3. A composition according to claim 1, characterised in that it further comprises a subtilisin protease enzyme in an amount in the range 0.1–50 GU/mg.

4. A composition according to claim 1, characterized in that on dissolution or dispersion at a surfactant level in the range of 0.4–0.8 g/l it generates a pH of more than 10, and comprises 10–90% by weight of a builder selected from the group consisting of alkali metal ortho-, pyro and tripolyphosphates and hexametaphosphates, silicates, carbonates, zeolites, borates, citrates, carbomethyloxysuccinates, nitrilotriacetates, ethylenediaminetetracetates, and polymeric electrolytes.

5. A composition according to claim 4, wherein said polymeric electrolyte is a polyacrylate or polymaleate.

6. A composition according to claim 4, wherein the builder is sodium silicate and the sodium silicate comprises 40–80% by weight of the composition.

7. A composition according to claim 4, wherein the composition additionally comprises caustic alkali.

8. A process of dishwashing, which comprises treating dishes with an aqueous wash liquor derived by dispersing or dissolving in water a dishwashing or rinsing composition comprising
(a) about 0.5 to 10% by weight of a surfactant;
(b) about 0.5 to 10% by weight of a chlorine-type bleaching agent; and
(c) a lipolytic enzyme in an amount in the range 0.005 to 100 lipase units per mg, dry wt., of the composition, wherein said lipolytic enzyme (c) is obtained by cloning the gene from Humicola lanuginosa and expressing this gene in Aspergillus oryzae, and wherein bleach component (b) is free of encapsulating agents or slow-release agents.

* * * * *